United States Patent [19]

Acton et al.

[11] 4,037,747

[45] July 26, 1977

[54] SAFETY CLOSURE CAP WITH TORQUE CONTROL

[75] Inventors: Daniel D. Acton; John W. Boerstler, both of Lancaster, Ohio

[73] Assignee: Anchor Hocking Corporation, Lancaster, Ohio

[21] Appl. No.: 688,594

[22] Filed: May 21, 1976

[51] Int. Cl.[2] ..... B65D 55/02

[52] U.S. Cl. ..... 215/219

[58] Field of Search ..... 215/219, 220, 329; 220/288, 304

[56] References Cited

U.S. PATENT DOCUMENTS

| | | | |
|---|---|---|---|
| 3,843,015 | 10/1974 | Blau | 220/288 |
| 3,917,098 | 11/1975 | Acton et al. | 215/219 |
| 3,986,634 | 10/1976 | Smith et al. | 220/288 |
| 3,989,153 | 11/1976 | McRoskey et al. | 215/220 |

*Primary Examiner*—George T. Hall

*Attorney, Agent, or Firm*—Holland, Armstrong, Wilkie & Previto

[57] ABSTRACT

An improved safety closure cap with an integral sealing torque control means is disclosed for use on medicine or other packages where it is desirable that children cannot open the package. The cap has an inner shell with container engaging thread means and an outer shell rotatably attached to the inner shell. Ratchet means including means for controlling the maximum cap application torque locks the shells together as they are turned onto a container. The ratchet means is inoperative as the cap is turned off permitting the outer shell to freely rotate on the inner shell. A second shell connecting means is provided for removal in the form of a pressure operated interlock which is activated by an adult's gripping certain portions of the shells to turn them off as a unit.

4 Claims, 11 Drawing Figures

SAFETY CLOSURE CAP WITH TORQUE CONTROL

BACKGROUND OF THE INVENTION

This invention relates to safety closure caps for sealing containers and more particularly to a torque controlled safety closure cap which may not be removed from a container by young children as it requires manipulation by a person having adult gripping and reasoning powers. The improved cap has torque control means icorporated in the cap itself for limiting the cap application torque so that the cap removal torque may be set at a desirable value.

A number of safety closures have been designed for use with medicine and other potentially dangerous products. These caps have in certain cases been effective but have been found to be used only with difficulty by normal adults as a result of the use of excess cap application torque. In other cases, safety closures have been too easily removed by young children because of inadequate sealing torque. The improved closure cap has a built in torque limiting means which enables the packer to apply the cap using regular sealing machines while obtaining predetermined sealing and removal torques.

The closure cap is an improvement over the cap of U.S. Pat. No. 3,917,098 dated Nov. 4, 1975 to Acton et al.

The improved safety closure of this invention combines protection against unauthorized or undesirable removal with an integral torque control device thereby not only solving the safety problem but also providing a unique improvement in cap application. The safety feature prevents removal of the cap in the absence of adult strength and reasoning capabilities. The integral torque control permits the cap to be applied with a precise maximum application torque which is independent of the sealing machine and which is determined by the cap itself. This eliminates over tightening or under tightening even though the cap is applied by relatively simple sealing machinery without torque control. This torque control is particularly useful in the safety cap as the safety ratchet arrangement may be designed to provide a cap application torque which works ideally with the removal technique required for normal adults and which at the same time guards against an unintentionally low sealing torque which might permit a child or other unauthorized person to remove the closure cap without using the prescribed removal manipulation.

These improvements are obtained by the provision of a closure cap having an inner and an outer shell which are rotatably interconnected. A ratchet coupling means with an integral torque control is provided for locking the shells together only when they are turned onto a container. A second connecting means activated by an appropriately applied pressure grip of the user is provided to interlock the shells for closure cap removal.

Accordingly, an object of the present invention is to provide an improved safety closure.

Another object of the invention is to provide a safety closure which is characterized by having an integral torque control which determines the sealing and removal torques.

Another object of the invention is to provide an improved safety package comprising an improved torque controlled safety closure useful with a container with a conventional closure engaging means.

Another object of the invention is to provide an effective torque controlled closure which is relatively easily manufactured and which may be applied to containers using conventional container sealing machinery.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings, forming a part of the specification, wherein.

DESCRIPTION OF THE PREFERRED EMBODIMENTS

A preferred embodiment of the safety package and the safety closure cap will now be described with reference to FIGS. 1 through 11.

Figure 1:
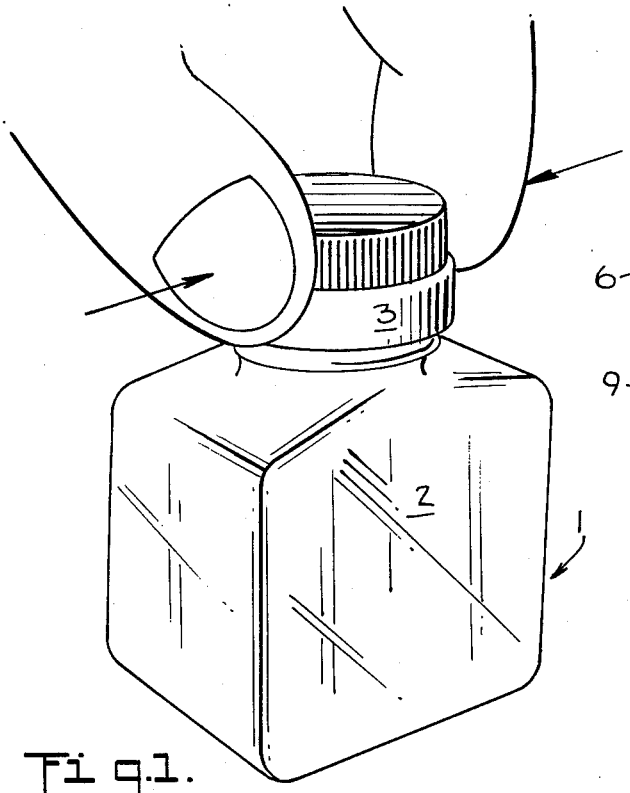
FIG. 1 is a perspective view of a preferred embodiment of a safety package sealed with the torque controlled safety closure of the invention.
Figure 3:
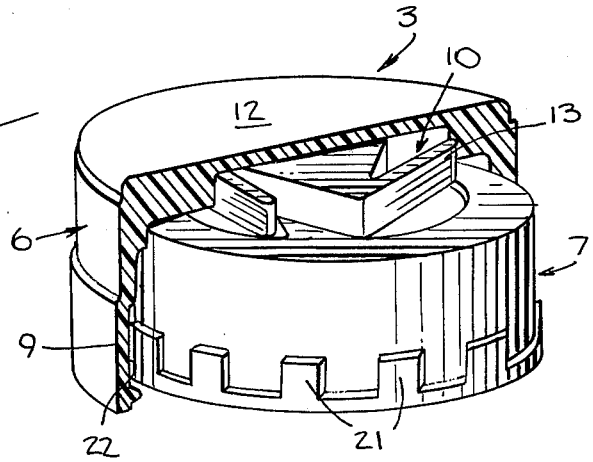
FIG. 3 is a perspective view, partially cut away, illustrating a preferred embodiment of the closure cap.
Figure 2:
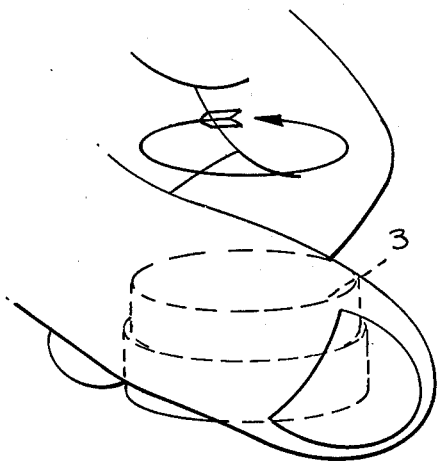
FIG. 2 is a perspective view showing the package of FIG. 1 with the closure cap removed.
Figure 4:
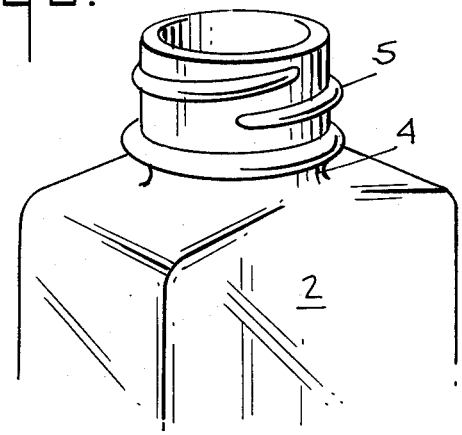
FIG. 4 is an exploded perspective view of the closure cap of FIG. 3.
Figure 4:
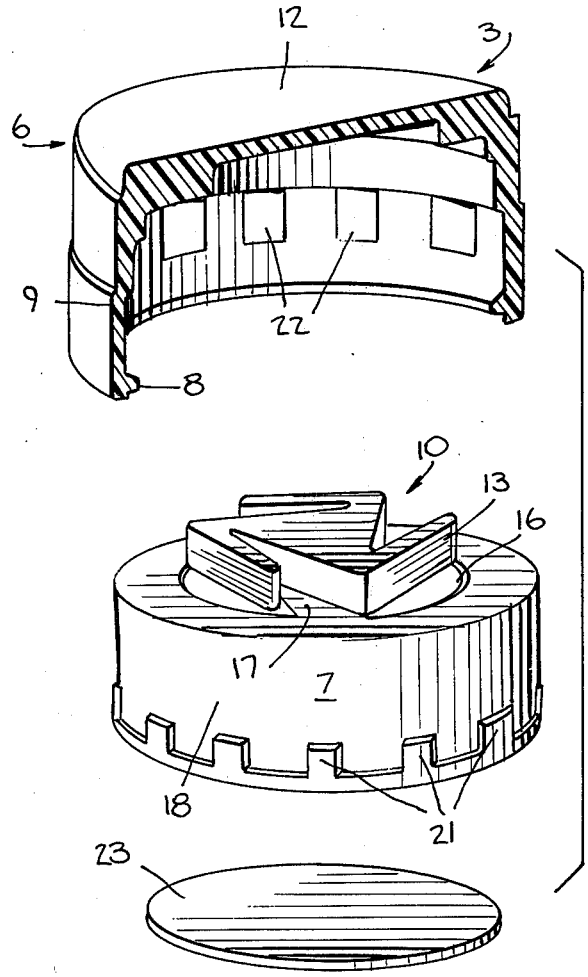

FIG. 1 illustrates a package 1 of the type used for products such as medicines where it is advantageous to have a safety closure. The package 1 includes a glass or plastic container 2 sealed by a torque controlled safety closure cap 3 in accordance with the present invention. The closure cap 3 may be removed by the user's manipulating the cap 3 in a particular way and which, as will be described below, is a manner not readily performed by small children or by other irresponsible persons. In FIG. 2 the cap 3 is shown removed from the container 2. The container 2 has a conventional neck 4 including a closure engaging screw thread 5 similar to that used for engaging regular molded plastic or other closure caps.

The preferred embodiment of the safety closure cap 3 has a cup-shaped outer shell 6 rotatably attached to a nesting inner shell 7. Relative rotation is provided for by the loose fit between the shells. The two shells 6 and 7 are held in their nested position (FIGS. 3 and 5) by an inwardly projecting bead 8 on the lower edge of the skirt 9 of the outer cap shell 6. When the safety closure cap 3 is applied to the container 2 during the regular sealing operation, as with automatic sealing equipment or otherwise, it is desirable that the inner and outer shells 6 and 7 turn as a unit when sealing torque is applied to the outer surface of the outer shell 6.

A ratchet 10 is provided for locking the shells 6 and 7 together for simultaneous turning when the outer shell 6 is turned onto the container 2. The ratchet 10 provides no interlock when the outer shell 6 is turned in the opposite or the cap removing direction. The ratchet 10 permits the outer shell 6 to turn freely on the inner shell 7 and the container 2 when the user attempts to remove the closure cap 3 from the container 2 in the ordinary way.

Figure 6:
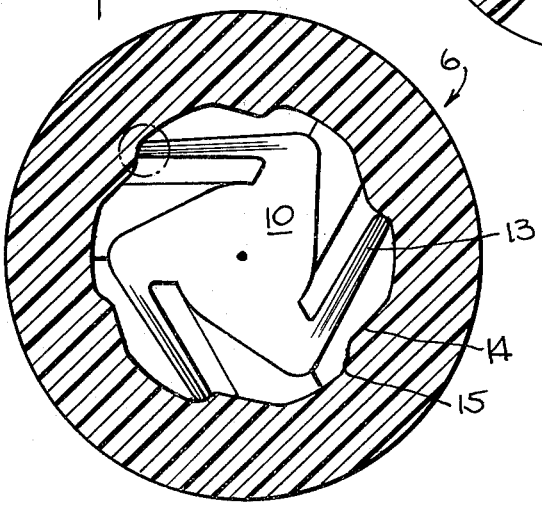
FIGS. 6 and 7 are horizontal sectional views of the closure cap of FIG. 3 illustrating a coupling ratchet in its cap applying and in its cap removal action, respectively.

A cavity 11 is provided in the underside of the outer cap shell 6 cover 12 to receive the ratchet pawl members 13. The generally circular edge of the cavity 11 has a number of ratchet teeth 14 (FIG. 6) formed on it with pawl engaging surfaces 15 as best seen in FIG. 6 whose torque control features will be further described below. A plurality of the flexible pawl members 13 are integrally formed on the top 16 of the inner shell 7 which also have torque control properties whose inter-action with the ratchet teeth 14 will be described below. This unitary construction includes a support section 17 preferably molded as an integral portion of the inner shell top 16 from which the flexible pawl members 13 project. The pawl 10 is conveniently formed as a unitary molded member with the inner shell 7 including the skirt 18 and container engaging threads 19.

Figure 5:
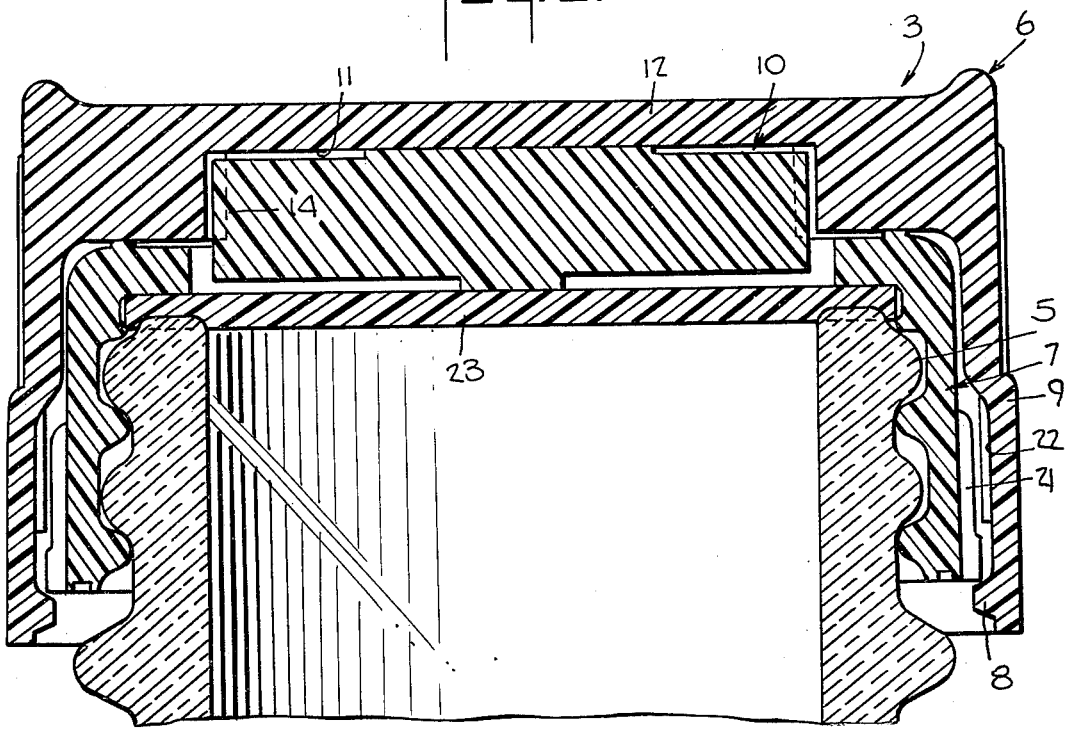
FIG. 5 is a vertical sectional view of the closure cap of FIG. 3 applied to the threaded neck of a glass container.

When the outer shell 6 is turned in a clockwise direction during cap application, the ratchet teeth 14 move into engagement with the pointed outer ends 13*A* of the pawl members 13 causing the inner shell 7 to turn with the outer shell 6 and causing the cap threads 19 to turn onto the complementary threads 5 on the container neck 4 forming a seal with sealing gasket 23 (FIG. 5).

When the outer cap shell 6 is turned in the opposite or counterclockwise direction, the ratchet teeth 14 snap over the flexible pawl member 13 permitting the outer shell 6 to rotate on the inner shell 7 so that the ratchet 10 provides no coupling force to permit the disengagement of the cap and container threads.

Figure 8:
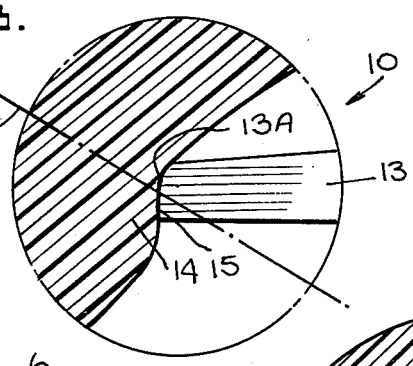
FIG. 8 is an enlarged fragmentary horizontal sectional view illustrating the torque controlling ratchet action.
Figure 7:
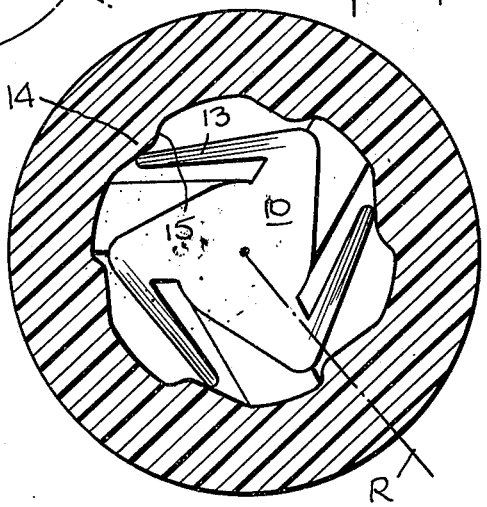
Figure 9:
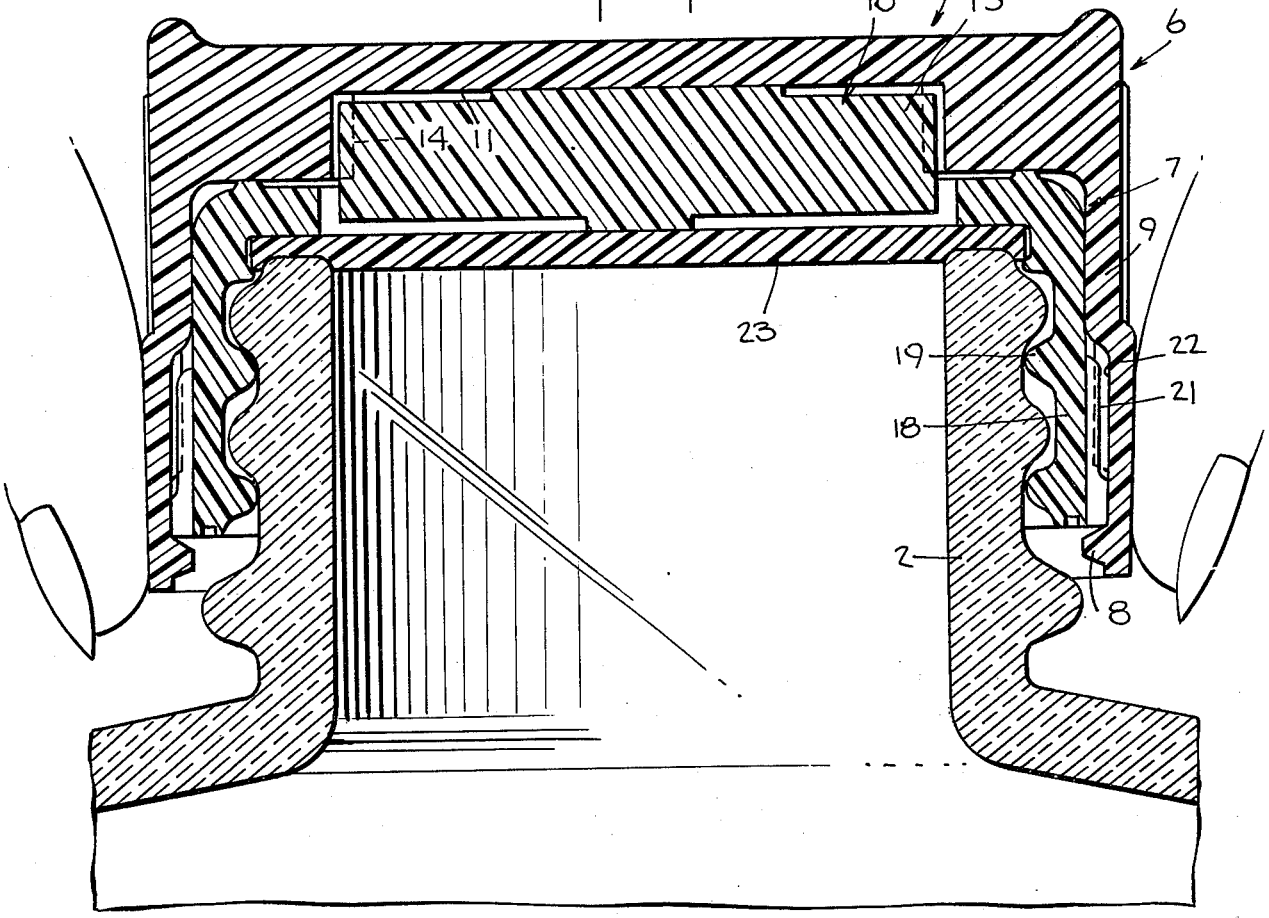
FIG. 9 is a vertical sectional view of the sealed package of FIG. 5 illustrating the removal of the safety closure from the container.
Figure 10:
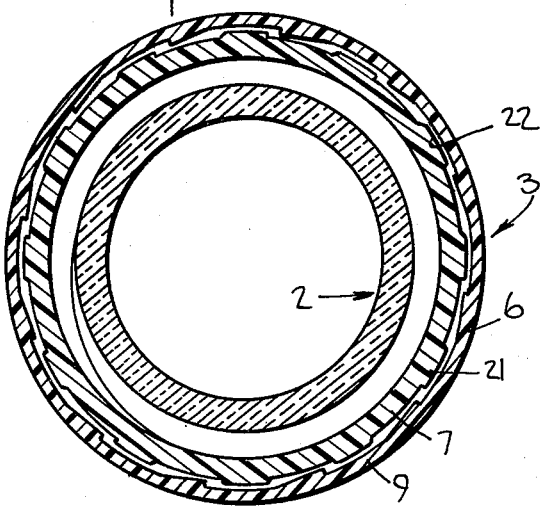
FIGS. 10 and 11 are horizontal sectional views illustrating the closure removal locking means in its cap sealing and in its cap removal positions, respectively.

The torque control which is provided as the cap 3 is applied to the containers 2 and as referred to above will now be described in greater detail with particular reference to FIGS. 6, 7 and 8. During the cap application, the flexible pawl members 13 are forced against the pawl engaging surfaces 15 of the ratchet members 14. As seen in FIG. 8, the surfaces 15 are formed so that they extend at an angle to a closure cap radius R drawn through the surface 15 from the closure cap center. The angular surface 15 engages the outer end 13*A* of the pawl member 13 which also has a slightly rounded surface particularly at the trailing edge of this surface during cap application. FIG. 8, for example, illustrates a ratchet tooth surface 15 having an angle of about 45° with the cap radius R. It is clear that the initial engagement of the pawl member end surfaces 13*A* with the ratchet teeth surfaces 15 will exert a significant turning force on the closure cap 3 during cap application. It is also clear that this cap turning force will build up as the closure 3 nears its fully sealed position and that at some point the flexible pawl members 13 will slide over the ratchet teeth 14 so that significant further tightening will not then occur. This arrangement therefore sets a maximum sealing torque which is applied during the sealing operation regardless of the particular sealing machine being used. The point at which the ratchet members 13 slip clear of the ratchet teeth 14 is a function of the angular relation between the teeth 14 and the ends of the pawl members 13 as further influenced by the particular materials used for the ratchet and pawl members and by the rigidity of the pawl members as determined by their cross-section. Once the plastics, which may be conventional closure resins, and the design of the ratchet members have been selected, a number of maximum torque values may be experimentally determined by testing a number of ratchet teeth and pawl member shapes. Finer adjustments may be determined by interpolating these results to produce caps having the particular application torques needed for particular usages.

An independent interlocking means is provided for releasably connecting the inner and outer cap shells 6 and 7 for cap removal. This means is provided on the flexible lower portion of the skirt 9 of the outer cap shell 6 and on the adjacent outer surface of the skirt 18 of the inner cap shell 7. To remove the cap 3, the skirt 9 of the outer cap shell 6 is pressed inwardly by a firm finger pressure in the manner illustrated in FIGS. 1 and 9. The pressure on the cap skirt 3, which only may be satisfactorily applied by a person with mature hands, results in an interlock between the skirt portions 9 and 18 of the two cap shells 6 and 7 and permits the user to turn the inner shell 7 along with the outer shell 6 to remove the cap 3 from the container as illustrated in FIG. 2. The cap removal action is facilitated by the use of a large number of spaced slots 22 on the inner surface of the outer shell 6 skirt 9 and a similar number of cooperating lugs or projections 21 positioned on the outer surface of the skirt 18 of the inner cap shell 7.

Figure 11:
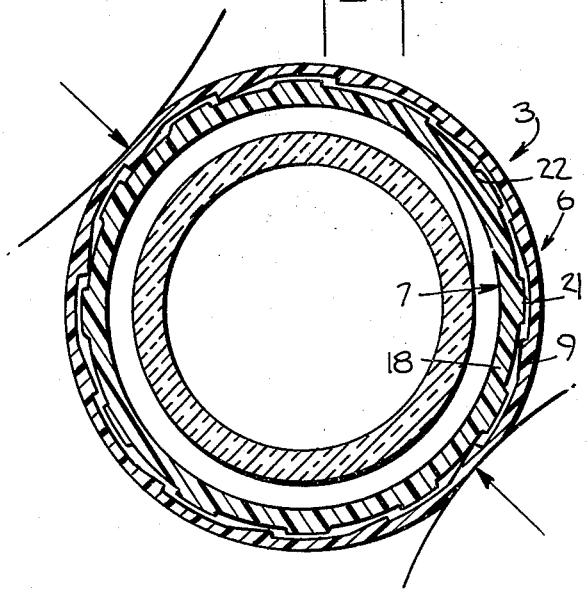

As the user presses inwardly on the closure cap skirt 9 and turns the outer shell 6, the slots 22 and lugs 21 will become aligned and engaged in the manner illustrated in FIG. 11 permitting the closure cap 3 to be turned off of the container 2. The thickness of the skirt 9 of the outer cap shell 6 is proportioned so that the necessary skirt deformation required for cap removal may only be obtained by a user having both mature finger size and strength. The shells 6 and 7 of the closure cap 3 may be molded from conventional plastics presently used for molded closure caps.

Where it is desirable to use this closure cap principally for torque control and where no safety feature is required, the cap may be modified to simplify the release mechanism. By reducing the pressure required to obtain the locking action on removal, the cap may be removed by anyone. One way, for example, is to decrease the skirt thickness on the outer shell 6. The lugs 21 and slots 22 may also be made deeper in this case.

It will be seen that an improved closure cap has been described which has an integral torque control means for limiting or setting the maximum cap application torque. This control is incorporated in a safety closure cap. The integral torque control is pre-set to limit the maximum torque which may be applied during the container sealing by the sealing machine. This torque value may thus be set to insure adequate sealing of the container and particularly to provide a desirable removal torque which is operative in combination with the safety release features of the closure cap.

The torque control is particularly important for safety closures as it insures that the cap is not so loosely applied that it may be removed without use of the safety release means. At the same time, the torque is set so that the closure cap is not over tightened thereby making use of the safety removal mechanism by adults too difficult. The preferred and improved structure which provides these results is relatively simple and is easily manufactured and the closure cap of the invention may be used to seal glass and other containers having conventional cap receiving threads or lugs.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described our invention, we claim:

1. In a container sealing safety closure having an outer shell and an inner shell both with tops and depending skirts and having means for rotatively coupling said shells together in nesting relationships and with container engaging means on said inner shell and a plurality of elongated pawls extending outwardly from a central support on the top of one of said shells for operatively engaging ratchet teeth on the other of said shells when said closure is turned on to the container the improvement comprising said pawls and said ratchet teeth having their contacting surfaces shaped for sliding friction engagement to slide over each other at a predetermined closure torque application value.

2. The safety closure as claimed in claim 1 in which said contacting surfaces of said ratchet teeth are at an acute angle to the elongated pawls.

3. The safety closure as claimed in claim 1 which further comprises pressure operated means for connecting said outer and inner shells for closure removal.

4. The safety closure as claimed in claim 1 in which said rotative coupling comprises an inwardly projecting bead on the outer shell.

* * * * *